US009643055B2

(12) United States Patent
Peloquin et al.

(10) Patent No.: US 9,643,055 B2
(45) Date of Patent: May 9, 2017

(54) SWIM FIN

(71) Applicant: TYR Sport, Inc., Farmingdale, NY (US)

(72) Inventors: Eric Carlin Peloquin, Brooklyn, NY (US); Philip Moses Bayer, Brooklyn, NY (US); Philip S. Kovanis, Babylon, NY (US)

(73) Assignee: TYR Sport, Inc., Farmingdale, NY (US)

( * ) Notice: Subject to any disclaimer, the term of this patent is extended or adjusted under 35 U.S.C. 154(b) by 0 days.

(21) Appl. No.: 14/878,401

(22) Filed: Oct. 8, 2015

(65) Prior Publication Data

US 2017/0100639 A1 Apr. 13, 2017

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/02; A63B 31/10; A63B 31/18
USPC ..... 441/56
See application file for complete search history.

(56) References Cited

U.S. PATENT DOCUMENTS 2,099,973 A 11/1937 de Corlieu
2,321,009 A 6/1943 Churchill
2,343,468 A 3/1944 Messinger
2,737,668 A 3/1956 Cressi et al.
2,779,077 A 1/1957 Kline
2,889,563 A * 6/1959 Lamb ..... A63B 31/11 441/64
3,082,442 A 3/1963 Cousteau et al.
3,178,738 A 4/1965 La Trell
3,411,165 A 11/1968 Murdoch
3,810,269 A 5/1974 Tabata et al.
4,300,255 A 11/1981 Beuchat
4,521,220 A 6/1985 Schoofs
4,689,029 A 8/1987 Ciccotelli
4,737,127 A 4/1988 Lamont
4,838,824 A 6/1989 McCredie
4,948,385 A 8/1990 Hall
(Continued)

FOREIGN PATENT DOCUMENTS

EP 0308998 A2 3/1989
EP 0436927 A1 7/1991
(Continued)

*Primary Examiner* — Stephen Avila
(74) *Attorney, Agent, or Firm* — Stetina Brunda Garred & Brucker

(57) ABSTRACT

A swim fin includes a foot pocket with a front and rear sections, an upper portion formed of an elastomeric material, a sole, and a foot pocket cavity. The rear section has a rear edge defining the foot pocket cavity. The foot pocket further has an array of through holes disposed through the upper portion adjacent the rear section. The array of through holes is sized and configured to generally increase a surface area of the rear section from the rear edge towards the front section. The swim fin includes a fin blade extending from the front section of the foot pocket. The swim flu may further include an adjustable heel strap. The fin blade may further include side rails attached to the foot pocket with hinges. The fin blade may further include a flex member disposed between first and second body members.

14 Claims, 7 Drawing Sheets

(56) References Cited

U.S. PATENT DOCUMENTS

| | | | | |
|---|---|---|---|---|
| 5,108,328 | A | 4/1992 | Hall | |
| 5,163,859 | A | 11/1992 | Beltrani et al. | |
| 5,183,424 | A | 2/1993 | Field | |
| 5,304,081 | A | 4/1994 | Takizawa | |
| 5,358,439 | A | 10/1994 | Paolo | |
| 5,387,145 | A | 2/1995 | Wagner | |
| 5,435,764 | A | 7/1995 | Testa et al. | |
| 5,443,593 | A | 8/1995 | Garofalo | |
| 5,702,277 | A | 12/1997 | Wagner | |
| 5,746,631 | A | 5/1998 | McCarthy | |
| 5,810,629 | A | 9/1998 | Parr | |
| 6,050,868 | A | 4/2000 | McCarthy | |
| 6,095,879 | A | 8/2000 | McCarthy | |
| 6,146,224 | A | 11/2000 | McCarthy | |
| 6,183,327 | B1 | 2/2001 | Meyer | |
| 6,568,974 | B2 | 5/2003 | Semeia | |
| 8,257,124 | B2 * | 9/2012 | Garofalo | A63B 31/11 441/64 |
| 2009/0176421 | A1 * | 7/2009 | Marote | A43B 5/08 441/64 |

FOREIGN PATENT DOCUMENTS

| | | | |
|---|---|---|---|
| EP | 0579046 | A1 | 1/1994 |
| EP | 0607568 | A1 | 7/1994 |

* cited by examiner

SWIM FIN

CROSS-REFERENCE TO RELATED APPLICATIONS

Not Applicable.

STATEMENT RE: FEDERALLY SPONSORED RESEARCH/DEVELOPMENT

Not Applicable

BACKGROUND

1. Technical Field

The present disclosure relates generally to swim fins More particularly, the present disclosure relates to a swim fin with enhanced ease of wearability and functionality.

2. Related Art

Swim fins are used for a wide variety of recreational, professional and emergency usages. Basic components include some form of foot pocket with a fin blade for propulsion. As advances in technology evolve, there are opportunities for advancement in the art with respect to ease of use, comfort and functionality.

In view of the foregoing, there is a need in the art for an improved swim fin.

BRIEF SUMMARY

In accordance with one embodiment, there is provided a swim fin for wearing upon a foot of a user. The swim fin includes a foot pocket. The foot pocket has a front section, a rear section, an upper portion formed of an elastomeric material, a sole, and a foot pocket cavity disposed between the upper portion and the sole. The rear section has a rear edge defining the foot pocket cavity. The foot pocket further has an array of through holes disposed through the upper portion adjacent the rear section. The array of through holes is sized and configured to generally increase a surface area of the rear section from the rear edge towards the front section. The swim fin further includes a fin blade extending from the front section of the foot pocket.

According to various embodiments, a sizing of the through holes may generally decrease in a direction from the rear section towards the front section. A spacing between the through holes in a direction lateral to the front and rear sections may generally increase in a direction from the rear section towards the front section. The through holes may be circular. The rear edge may be upturned away from the foot pocket cavity. The foot pocket may have opposing lateral sides extending along the front and rear sections. The foot pocket may further have a pair of drain holes formed through the upper portion at the front section and respectively adjacent to the opposing lateral sides.

In accordance with another embodiment, there is provided another swim fin. The swim fin includes a foot pocket, a fin blade, and an adjustable heel strap. The foot pocket has a front section, a rear section, opposing lateral sides disposed along the front and rear sections, an upper portion formed of an elastomeric material, a sole, a foot pocket cavity disposed between the upper portion and the sole, and an insert anchor portion. The fin blade extends from the front section of the foot pocket. The adjustable heel strap is attached to the lateral sides at the rear section of the foot pocket. The heel strap has an elongate flexible strap member extending across the foot pocket cavity adjacent the rear section. The heel strap further has a quick release insert having an insert body, a release clip, and a strap retention bar. The release clip and the insert anchor portion are cooperatively sized and configured for the insert anchor portion to receive the release clip along an axis of insertion. The release clip has a locked position with the release clip resisting removal of the release clip from within the insert anchor portion. The insert is rotatably engaged with foot pocket with the release clip inserted in the insert anchor portion in the locked position. The release clip has an unlocked position with the release clip not resisting removal of the release clip from within the insert anchor portion along the axis of insertion. The heel strap further has a strap adjustment member attached to the insert. The strap adjustment member is sized and configured to engage the strap member. The strap adjustment member has an engaged position with the strap adjustment member engaged with the strap member to resist longitudinal movement of the strap member about the strap retention bar. The strap adjustment member has an unengaged position with the strap adjustment member not engaged with the strap member.

According to various embodiments, the release clip may have a circular body concentrically received by the insert anchor portion upon insertion of the release clip into the insert anchor portion in the locked position. The release clip may be configured to flex between the locked and unlocked positions. The insert anchor portion may be overmolded with the upper portion. The strap member may include a plurality of protrusions disposed along the strap member. The strap adjustment member may be configured to engage a respective one of the plurality of the protrusions in the engaged position. The strap adjustment member may be configured to flex between the engaged and unengaged positions.

In accordance with another embodiment, there is provided a swim fin for wearing upon a foot of a user. The swim fin includes a foot pocket and a fin blade. The foot pocket has a front section, a rear section, a first lateral side and an opposing second lateral side with the lateral sides being disposed along the front and rear sections, an upper portion formed of an elastomeric material, a sole, and a foot pocket cavity disposed between the upper portion and the sole. The fin blade extends from the front section of the foot pocket. The fin blade has first and second side rails. Each side rail has a foot pocket end and a blade tip end. The fin blade further has first and second hinges. The first hinge is attached to the first lateral side and the foot pocket end of the first side rail. The second hinge is attached to the second lateral side and the foot pocket end of the second side rail. The first hinge is sized and configured to flex to allow rotation of the first side rail about an axis generally parallel to the first lateral side. The second hinge is sized and configured to flex to allow rotation of the second side rail about an axis generally parallel to the second lateral side. The fin blade further has an elastomeric flex member attached to the front section of the foot pocket and attached to and disposed between the first and second side rails. The flex member extends from the front section of the foot pocket to adjacent and between the blade tip ends of the first and second side rails. The flex member has a stiffness less than a stiffness of each of the first and second side rails.

According to various embodiments, the first hinge may be generally elongate and extending along the first lateral side, and the second hinge may be generally elongate and extending along the second lateral side. The first hinge may have a cross-sectional area less than a cross-sectional area of the first side rail adjacent the first hinge, and the second hinge may have a cross-sectional area less than a cross-sectional area of the second side rail adjacent the second hinge. The first hinge may be integrally formed with the first side rail, and the second hinge is integrally formed with the second side rail. The fin blade further may further include first and second fin body members. The first and second fin body members may be generally planar. The first fin body member may be disposed between and attached to the first side rail and the flex member, and the second fin body member may be disposed between and attached to the second side rail and the flex member. The flex member may have a stiffness less than a stiffness of each of the first and second fin body members.

According to yet another embodiment, there is provided a swim fin for wearing upon a foot of a user. The swim fin includes a foot pocket and a fin blade. The foot pocket has a front section, a rear section, a first lateral side and an opposing second lateral side with the lateral sides being disposed along the front and rear sections, an upper portion formed of an elastomeric material, a sole, and a foot pocket cavity disposed between the upper portion and the sole. The fin blade extends from the front section of the foot pocket. The fin blade has first and second side rails. Each side rail has a foot pocket end and a blade tip end. The first side rail is attached to the first lateral side adjacent the foot pocket end of the first side rail. The second side rail is attached to the second lateral side adjacent the foot pocket end of the second side rail. The fin blade further has an elastomeric flex member attached to the front section of the foot pocket and attached to and disposed between the first and second side rails. The flex member extends from the front section of the foot pocket to adjacent and between the blade tip ends of the first and second side rails. The flex member has a stiffness less than a stiffness of each of the first and second side rails. The flex member has corrugations extending generally parallel to the first and second side rails adjacent the foot pocket ends. The fin blade further has first and second fin body members. The first and second fin body members are generally planar. The first fin body member is disposed between and attached to the first side rail and the flex member, and the second fin body member is disposed between and attached to the second side rail and the flex member. Each of the first and second fin body members having a stiffness greater than a stiffness of flex member.

The flex member may be sized and configured to flex upon opposing rotational movement of the first and second fin body members about axes of rotation generally parallel to the first and second side rails. The flex member may be attached to the upper portion at the front section and adjacent to the first and second lateral sides.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
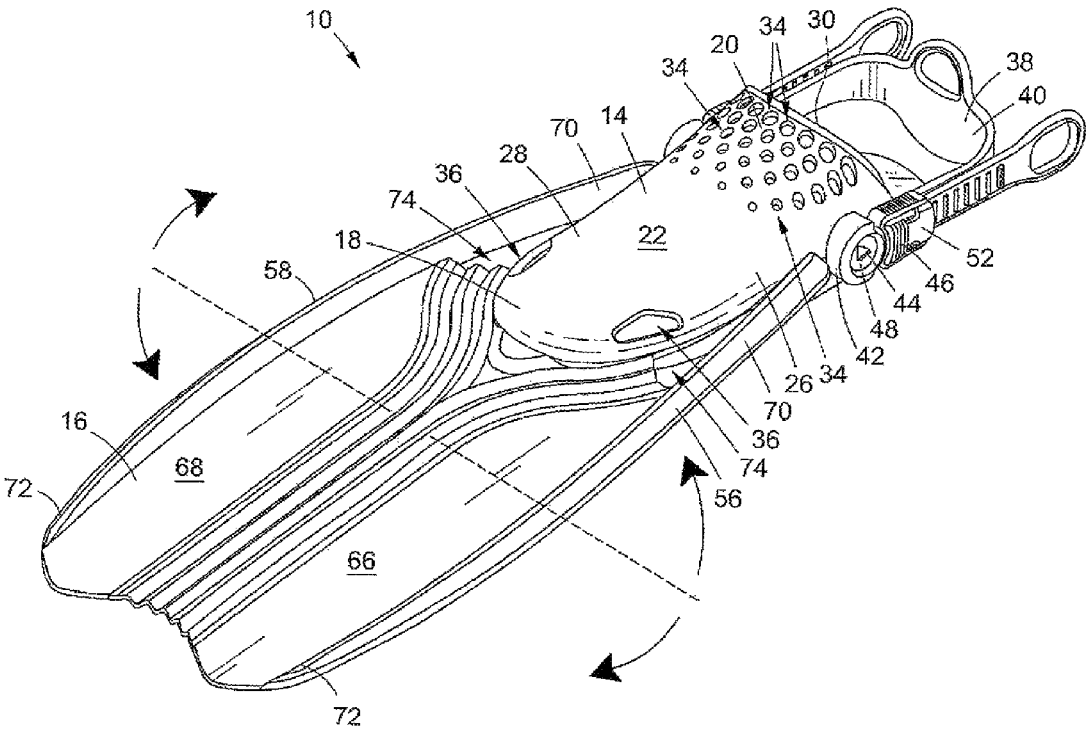
FIG. 1 is a perspective view of a swim fin according to an embodiment of the invention.
Figure 2:
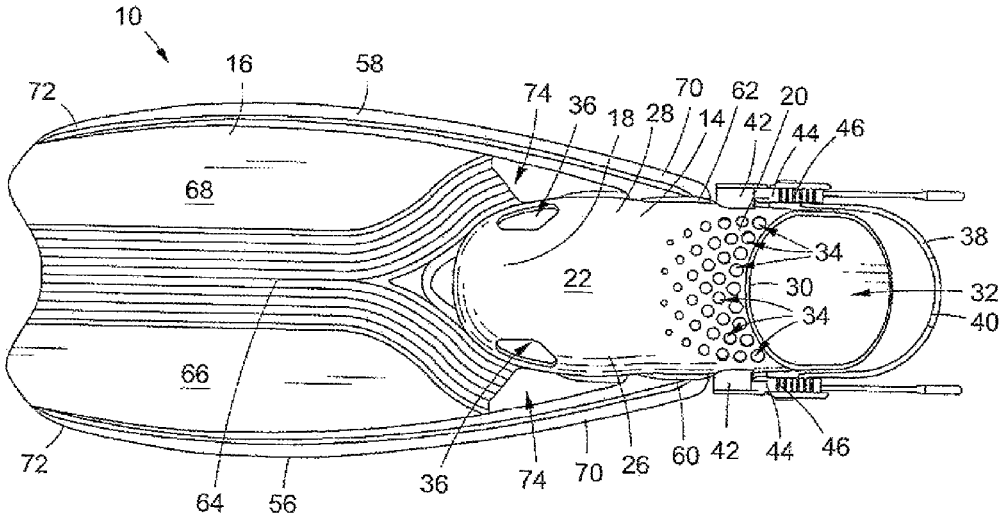
FIG. 2 is a top view of the swim fin of FIG. 1.
Figure 3:
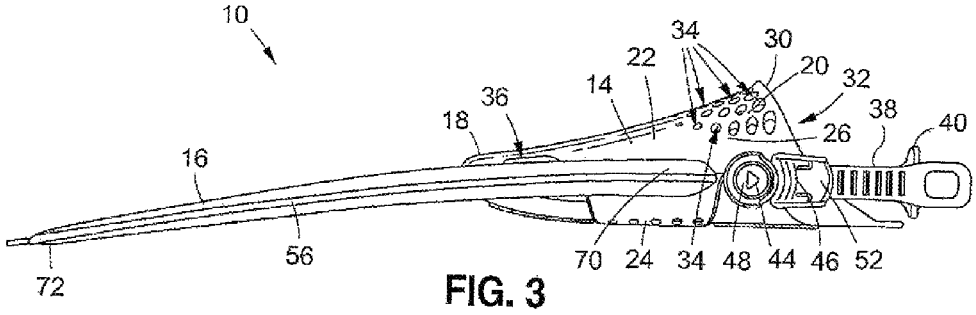
FIG. 3 is a side view of the swim fin of FIG. 1.
Figure 4:
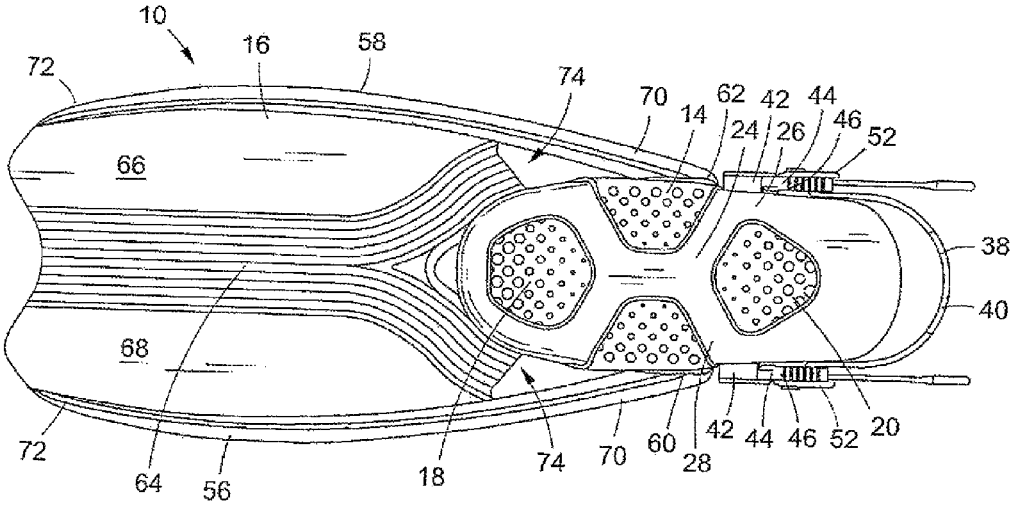
FIG. 4 is a bottom view of the swim fin of FIG. 1.
Figure 5:
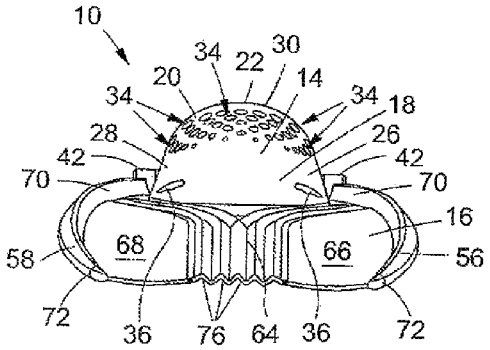
FIG. 5 is a front, view of the swim fin of FIG. 1.
Figure 6:
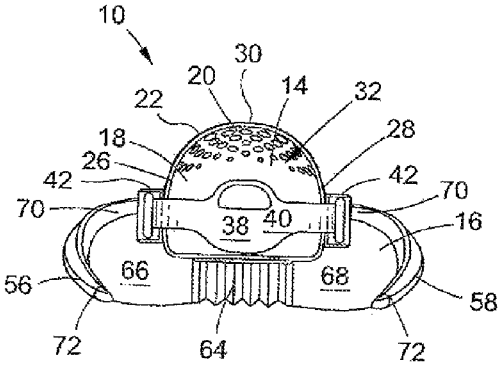
FIG. 6 is a rear view of the swim fin of FIG. 1.
Figure 7:
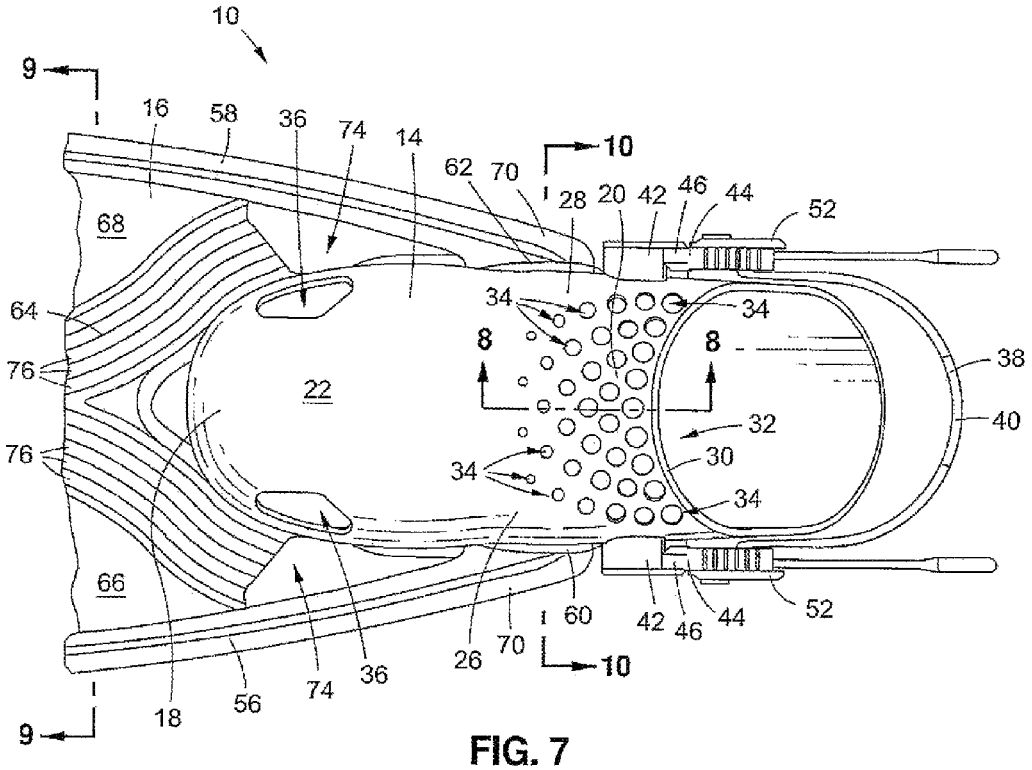
FIG. 7 is an enlarged partial view of the swim fin of FIG. 2.
Figure 8:
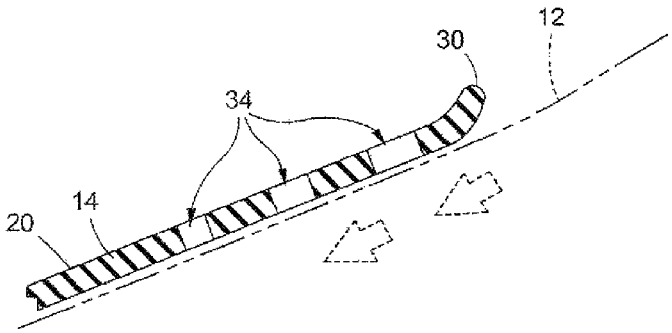
FIG. 8 is a cross-sectional view of a portion of a foot pocket of the swim fin of FIG. 7 as viewed along axis 8-8 of FIG. 7.
Figure 9:
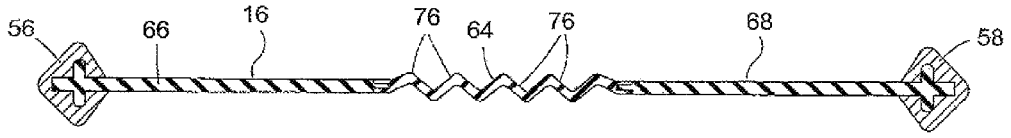
FIG. 9 is a cross-sectional view of a portion of a fin blade of the swim fin of FIG. 7 as viewed along axis 9-9 of FIG. 7.
Figure 10:
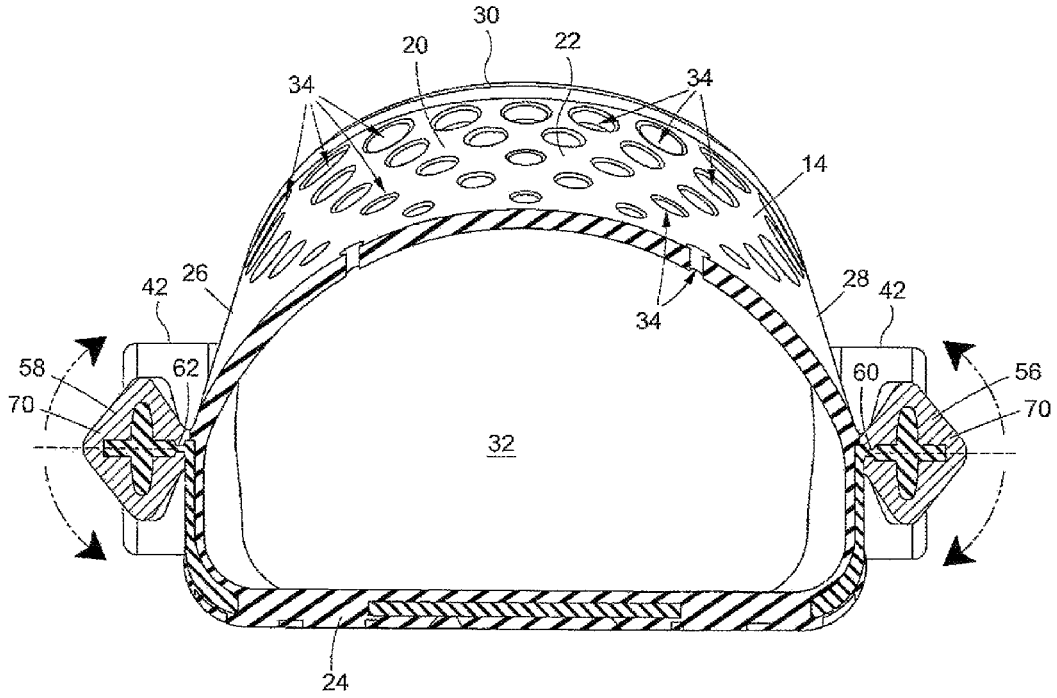
FIG. 10 is a cross-section view of a portion of the foot pocket of the swim fin of FIG. 7 as viewed along axis 10-10 of FIG. 7.
Figure 11:
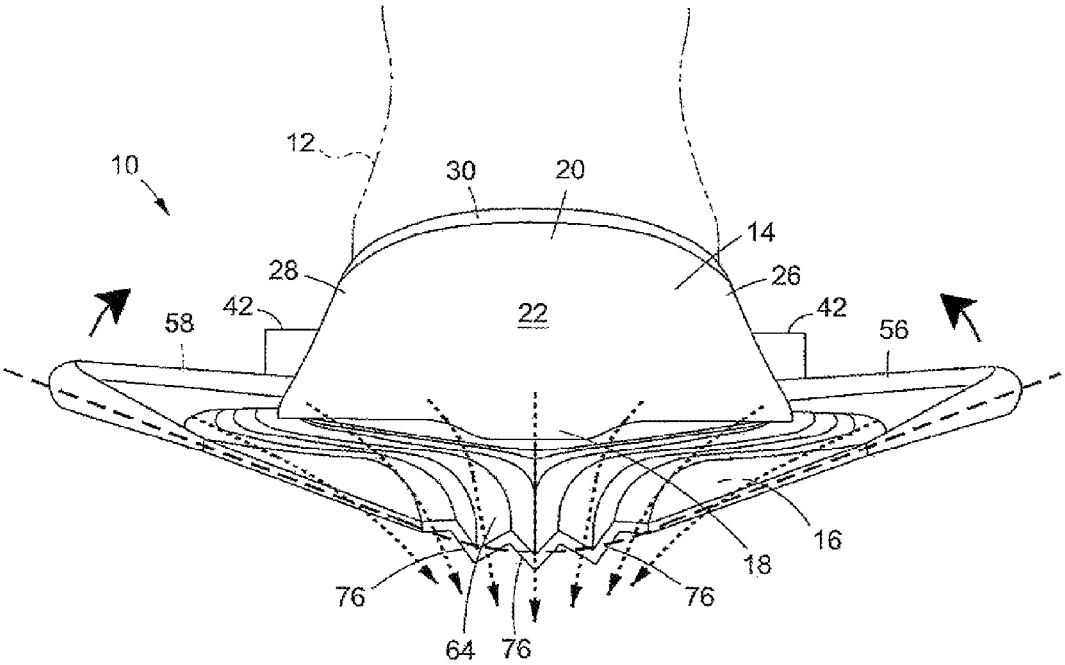
FIG. 11 is a front view of the swim fin of FIG. 1 as worn upon a foot of a user with water flow lines (indicated in dashed lining) as may be associated with an upward kicking motion.
Figure 12:
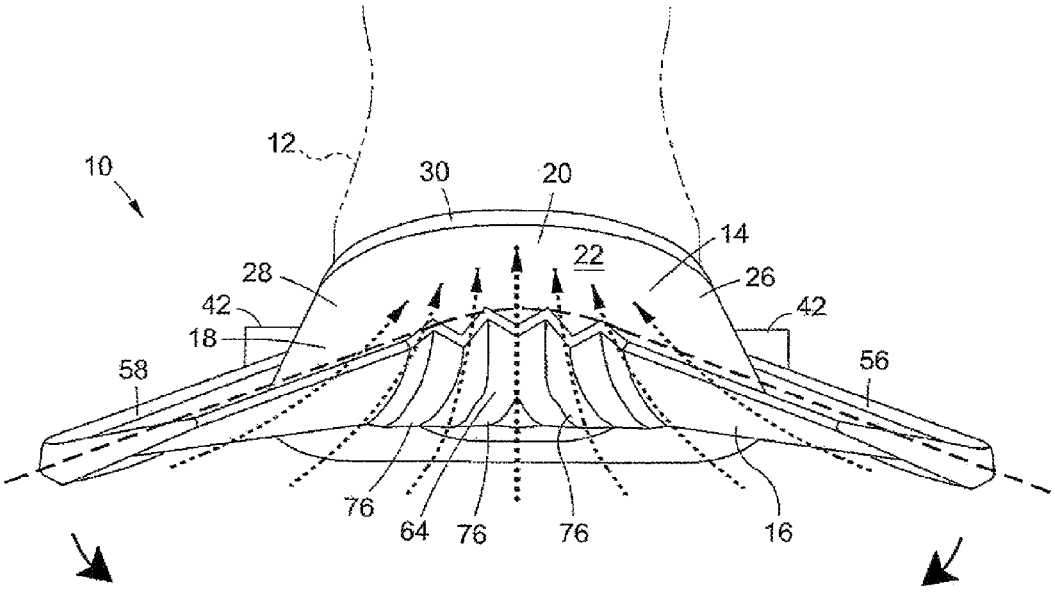
FIG. 12 is the front view of the swim fin, of FIG. 11 as may be associated with a downward kicking motion.

Referring now to FIG. 1, there is depicted a perspective view of a swim fin 10 according to various aspects of the inventions described herein. FIG. 2-6 respectively depict top, side, bottom, front and rear views of the swim fin 10. FIG. 7 is an enlarged partial view of the swim fin 10 of FIG. 2, and FIG. 8 is a cross-sectional view of a portion of a foot pocket 14 of the swim fin 10 of FIG. 7 as viewed along axis 8-8 of FIG. 7. FIG. 9 is a cross-sectional view of a portion of a fin blade 16 of the swim fin 10 of FIG. 7 as viewed along axis 9-9 of FIG. 7, and FIG. 10 is a cross-sectional view of a portion of a foot pocket of the swim fin 10 of FIG. 7 as viewed along axis 10-10 of FIG. 7. FIG. 11 is a front view of the swim fin 10 of FIG. 1 as worn upon a foot 12 of a user with water flow lines (indicated in dashed lining) as may be associated with an upward kicking motion, and FIG. 12 is the front view of the swim fin 10 of FIG. 11 as may be associated with a downward kicking motion.

In accordance with one embodiment, there is provided the swim fin 10 for wearing upon the foot 12 of a user. The swim fin 10 includes the foot pocket 14. The foot pocket has a front section 18, a rear section 20, an upper portion 22 formed of an elastomeric material, a sole 24, and a foot pocket cavity 32 disposed between the upper portion 22 and the sole 24. The rear section 20 has a rear edge 30 defining the foot pocket cavity 32. The foot pocket 14 further has an array of through holes 34 disposed through the upper portion 22 adjacent the rear section 20. The array of through holes 34 is sized and configured to generally increase a surface area of the rear section 20 from the rear edge towards the front section 18. The swim fin 10 further includes the fin blade 16 extending from the front section 18 of the foot pocket 14.

It is contemplated that the configuration of the array of through holes 34 allows for an increased susceptibility of the upper portion 22 is be stretched or elastically deformed in the region towards the rear section 20. As such the material of the upper portion 22 may "give" upon the foot 12 of the user being inserted into the foot pocket cavity 32 and during use for enhanced ease of putting on the swim fin 10 and comfort.

According to various embodiments, a sizing of the through holes 34 may generally decrease in a direction from the rear section 20 towards the front section 18. A spacing between the through holes 34 in a direction lateral to the front and rear sections 18, 20 may generally increase in a direction from the rear section 20 towards the front section 18. Further, the through holes 34 may be circular.

The rear edge 30 may be upturned away from the foot pocket cavity 32 as best viewed in cross-sectional side view of FIG. 8. Such an upturned configuration facilitates not only as ease of insertion of the foot 12 but also a comfortable fit while the swim fin is in use.

The foot pocket 14 may have opposing lateral sides, denoted a first lateral side 26 and an opposing second lateral side 28, extending along the front and rear sections 18, 20. The foot pocket 14 may further have a pair of drain holes 36 formed through the upper portion 22 at the front section 18 and respectively adjacent to the opposing first and second lateral sides 26, 28. The drain holes 36 are contemplated to allow for fluid drainage from within the foot pocket 14. Also, the drain holes 36 are contemplated to remove possible lateral pressure points at the front of the foot 12 as well as allow for stretch of the upper portion at such locations to further accommodate the foot 12 for comfortable wear.

It is contemplated that the various components of the swim fin 10 (as discussed above, and as discuss in the various embodiment below) may be constructed of materials and according to those manufacturing processes that are well known to one of ordinary skill in the art.

Figure 13:
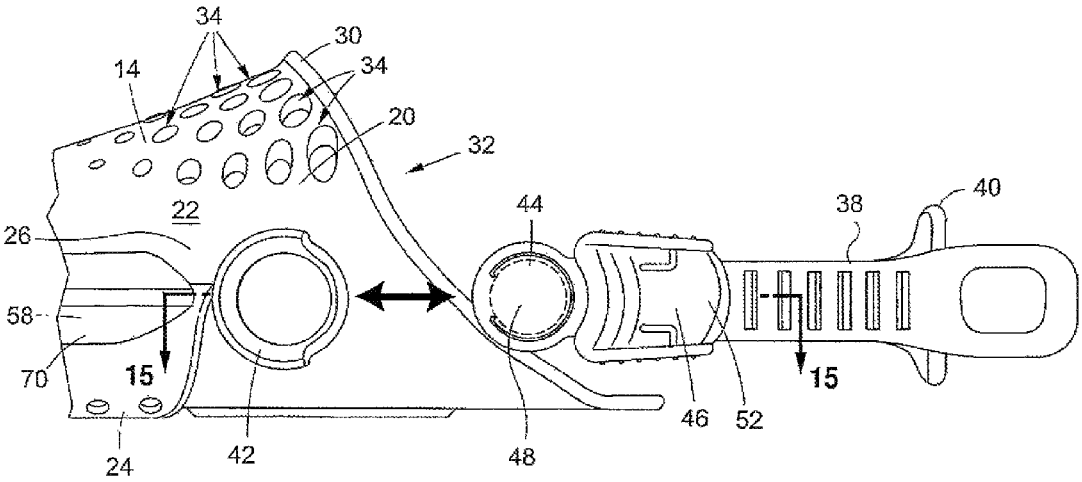
FIG. 13 is an enlarged side view of a portion of the swim fin with an adjustable heel strap in an unlocked position.
Figure 14:
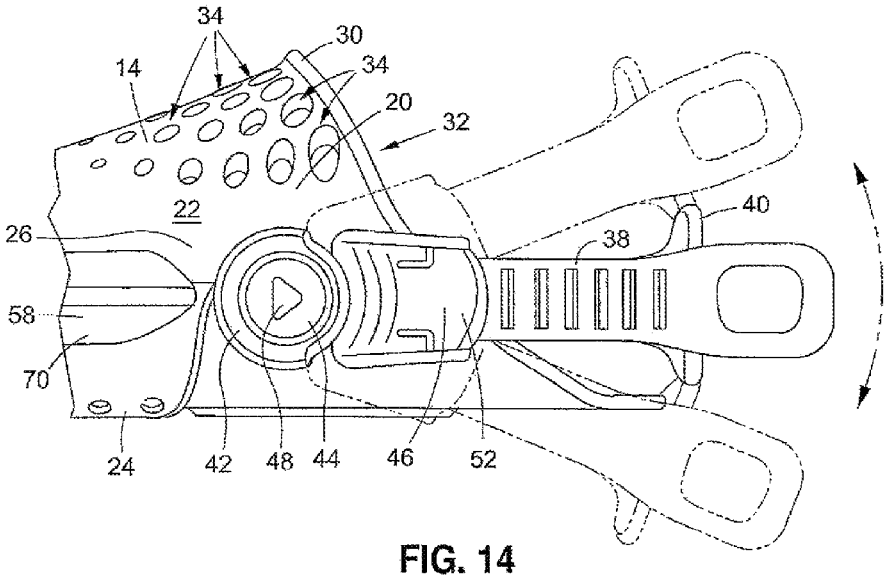
FIG. 14 is the enlarged side view of a portion of the swim fin of FIG. 13 with the adjustable heel strap in a locked position (with exemplary other positions of the heel strap indicated in dashed lining)
Figure 15:
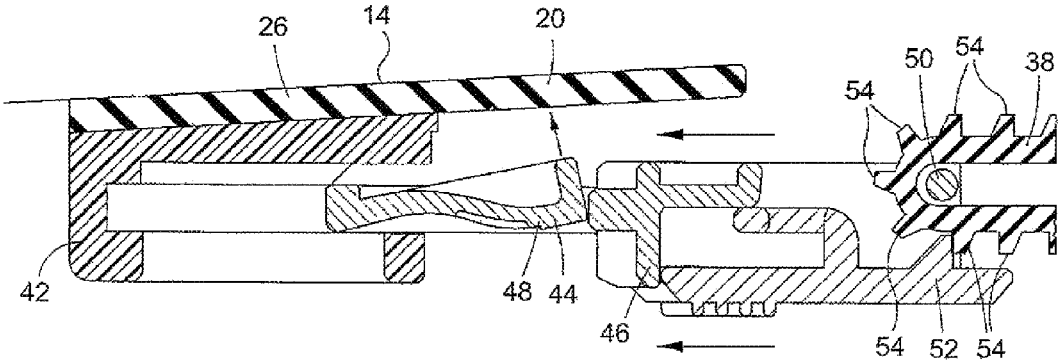
FIG. 15 is an enlarged partial top view of the swim fin with a quick release insert shown in an unlocked position.
Figure 16:
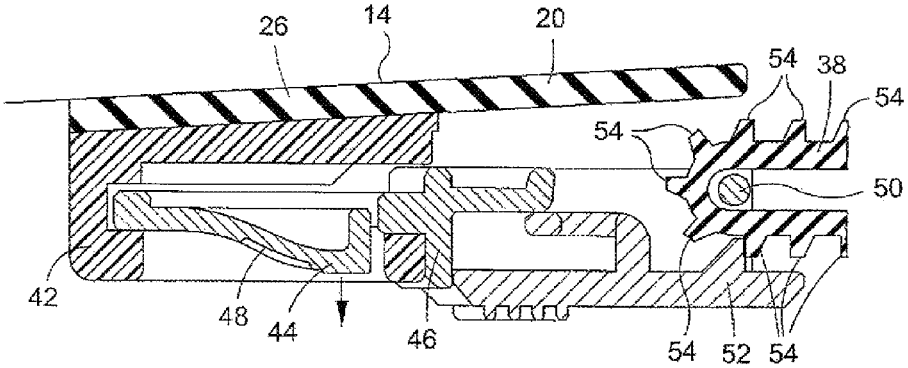
FIG. 16 is the enlarged partial top view of the swim fin of FIG. 15 with the quick lease insert shown in an unlocked position and a strap adjustment member in an engaged position.
Figure 17:
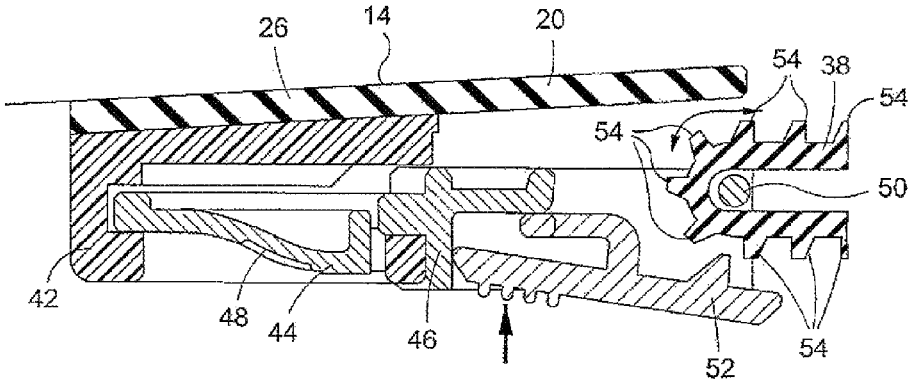
FIG. 17 is the enlarged partial top view of the swim fin of FIG. 16 with the strap adjustment member in an unengaged position.

Referring now to FIG. 13 there is depicted an enlarged side view of a portion of the swim fin 10 with an adjustable heel strap 38 in an unlocked position. FIG. 14 is the enlarged side view of a portion of the swim fin 10 of FIG. 13 with the adjustable heel strap 38 in a locked position (with exemplary other positions of the heel strap 38 indicated in dashed lining). FIG. 15 is an enlarged partial top view of the swim fin 10 with a quick release insert 44 shown in an unlocked position. FIG. 16 is the enlarged partial top view of the swim fin 10 of FIG. 15 with the quick lease insert 44 shown in an unlocked position and a strap adjustment member 52 in an engaged position. FIG. 17 is the enlarged partial top view of the swim fin of FIG. 16 with the strap adjustment member 52 in an unengaged position.

In accordance with another embodiment, there is provided another swim fin 10. The swim tin 10 includes the foot pocket 14, the fin blade 16, and the adjustable heel strap 38. The foot pocket 14 has the front section 18, the rear section 20, the opposing first and second lateral sides 26, 28 disposed along the front and rear sections 18, 20, the upper portion 22 formed of an elastomeric material, the sole 24, the foot pocket cavity 32 disposed between the upper portion 22 and the sole 24, and an insert anchor portion 42. The fin blade 16 extends from the front section 18 of the foot pocket 14. The adjustable heel strap 38 is attached to the lateral sides 26, 28 at the rear section 20 of the foot pocket 14. The heel strap 38 has an elongate flexible strap member 40 extending across the foot pocket cavity 32 adjacent the rear section 20. The heel strap 38 further has the quick release insert 44 having an insert body 46, a release clip 48, and a strap retention bar 50. The release clip 48 and the insert anchor portion 42 are cooperatively sized and configured for the insert anchor portion 42 to receive the release clip 48 along an axis of insertion. The release clip 48 has a locked position with the release clip resisting removal of the release clip from within the insert anchor portion 42. The insert 44 is rotatably engaged with foot pocket 14 with the release clip 48 inserted in the insert anchor portion 42 in the locked position. The release clip 48 has an unlocked position with the release clip 48 not resisting removal of the release clip 48 from within the insert anchor portion 42 along the axis of insertion. The heel strap 38 further has the strap adjustment member 52 attached the insert 44. The strap adjustment member 52 is sized and configured to engage the strap member 40. The strap adjustment member 52 has an engaged position with the strap adjustment member 52 engaged with the strap member 40 to resist longitudinal movement of the strap member 40 about the strap retention bar 50. The strap adjustment member 52 has an unengaged position with the strap adjustment member 52 not engaged with the strap member 40.

The strap adjustment member 52 may be used to adjust the fit of the heel strap 38 about the foot 12 of the user when wearing the swim fin. The quick release insert 44 is contemplated to facilitate an unlocking of the heel strap 38 from the foot pocket 14 to allow removal of the swim fin 10. Significantly, the quick release insert 44 allow removal without the need to adjust the effective length of the heel strap 38. As such, when putting the swim fin 10 back on, the user need only reinsert the insert 44 into the insert anchor portion 42 in the locked position. This avoids having to re-adjust the effective length the heel strap. The combination of the locking of the insert 44 and the engagement of the strap adjust member allows for "fine" and "quick release" types of adjustments in a single configuration.

According to various embodiments, the release clip 48 may have a circular body concentrically received by the insert anchor portion 42 upon insertion of the release clip 48 into the insert anchor portion 42 in the locked position. Such circular configuration is contemplated to be a way to facilitate the insert 44 to be rotatably engaged with foot pocket 14 with the release clip 48 inserted in the insert anchor portion 42 in the locked position. FIG. 14 illustrates the insert 44 in exemplary rotational positions (as indicated in dashed lining) Such rotation is contemplated to facilitate that strap member 40 to be rotationally adjusted to accommodate proper and comfortable fit upon the foot 12 of the user.

It is contemplated that the insert anchor portion 42 may be overmolded with the upper portion 22. The insert anchor portion 42 may be formed of a semi-rigid plastic material The strap member 40 may include a plurality of protrusions 54 disposed along the strap member 40. The strap adjustment member 52 may be configured to engage a respective one of the plurality of the protrusions 54 in the engaged position, such as depicted in FIG. 16. It is contemplated that the strap member 40 may be formed of a flexible material, such as a silicon rubber, and the protrusions 54 may be readily formed through a molding process. The release clip 48 may also be formed of a semi-rigid plastic material.

The release clip 48 may be configured to flex between the locked and unlocked positions. The release clip 48 is depicted in an unlocked position in FIG. 15. The release clip 48 is also depicted in FIG. 15 as, being in a flexed position from its normal position. In the embodiment depicted, the user would either press the release clip 48 to flex it upon insertion into the insert anchor portion 42 or simply forcefully insert the release clip 48 into the insert anchor portion 42 along, the axis of insertion and allow the interference of the release clip 48 with the insert anchor portion 42 to apply the needed lateral force to flex the release clip 48. Upon full insertion of the release clip 48 into the insert anchor portion 42, the release clip 48 would re-flex back into its normal position and the release insert 44 would assume the locked position. In this regard, movement of the release clip 48 is impeded by surrounding insert anchor portion 42. Upon a desire to remove the release insert 44, the release clip 48 can be flexed to avoid impeding contact with the surrounding insert anchor portion 42 in an opposition direction along the axis of insertion. The release insert 44 may be formed of a single piece of flexible material. As such, this may avoid assembly of multiple components, possible undesirable disassembly or breakage of components, and likely increased, relative costs associated with multiple components.

The strap adjustment member 52 may be configured to flex between the engaged, and unengaged positions. The strap adjust member 52 is depicted in an engaged position in FIG. 16. To move the strap adjustment member 52 to an unengaged position, the user may simply press, upon the strap engagement member 52 to cause it to flex as depicted in FIG. 17. This allows for an ease of making adjustments to the effective length of the heel strap 38. The strap adjustment member 52 may be formed of a single piece of flexible material. This may avoid assembly of multiple components, possible undesirable disassembly or breakage of components, and likely increased relative costs associated with multiple components. Moreover, it is contemplated that the release clip 48 and the strap adjustment member 52 may be formed of a single integrated part. Such integration may further avoid assembly of multiple components, possible undesirable disassembly or breakage of components and likely increased relative costs associated with multiple components.

As discussed above, the foot pocket 14 includes the insert anchor portion 42 that engages the release clip 48. In this regard, an insert anchor portion 42 may be provided at each of the first and second lateral sides 26, 28. The heel strap 38 may include a pair release clips 48 for each end of the strap member 40. The protrusion 54 may be provided at each end, of the strap member 40. As such, where two such release clips 48 are provided the heel strap 38 may be unlocked from either side of the swim fin 10. However, the swim fin 10 may be implemented with only a single release insert 44 and corresponding insert anchor portion 42.

In accordance with another embodiment, there is provided the swim fin 10 for wearing upon the foot 12 of a user. The swim fin 10 includes the foot pocket 14 and the fin blade 16. The foot pocket 14 has the front section 18, the rear section 20, the first lateral side 26 and the opposing second lateral side 28 with the lateral sides 26, 28 being disposed along the front and rear sections 18, 20, the upper portion 22 formed of an elastomeric material, the sole 24, and the foot pocket cavity 32 disposed between the upper portion 22 and the sole 24. The fin blade 16 extends from the front section 18 of the foot pocket 14. The fin blade 18 has first and second side rails 56, 58. Each side rail 56, 58 has a foot pocket end 70 and a blade tip end 72. The fin blade 16 further has first and second hinges 60, 62. The first hinge 60 is attached to the first lateral side 26 and the foot pocket end 70 of the first side rail 56. The second hinge 62 is attached to the second lateral side 28 and the foot pocket end 70 of the second, side rail 58. The first hinge 60 is sized and configured to flex to allow rotation of the first side rail 56 about an axis generally parallel to the first lateral side 26. The second hinge 62 is sized and configured to flex to allow rotation of the second side rail 58 about an axis generally parallel to the second lateral side 28. The fin blade 16 further has an elastomeric flex member 64 attached to the front section 18 of the foot pocket 14 and attached to and disposed between the first and second side rails 56, 58. The flex member 64 extends from the front section 18 of the foot pocket 14 to adjacent and between the blade tip ends 72 of the first and second side rails 56, 58. The flex member 64 has a stiffness less than a stiffness of each of the first and second side rails 56, 58.

As mentioned above, the first hinge 60 is sized and configured to flex to allow rotation of the first side rail 56 about an axis generally parallel to the first lateral side 26, and the second hinge 62 is sized and configured to flex to allow rotation of the second side rail 58 about an axis generally parallel to the second lateral side 28. FIG. 10 is a cross-sectional view of a portion of the foot pocket 14 of the swim fin 10 of FIG. 7 as viewed along axis 10-10 of FIG. 7. Rotational indicator lines depicted in dashed lining generally indicate the directions of rotational movement of the first and second side rails 56, 58. FIG. 11 is a front view of the swim fin 10 of FIG. 1 as worn upon a foot 12 of a user with water flow lines (indicated in dashed lining) as may be associated with an upward kicking motion. In this view the first side rail 56 is rotated in a counter-clockwise direction, and the second side rail 58 is rotated in a clockwise direction. FIG. 12 is the front view of the swim fin 10 of FIG. 11 as may be associated with a downward kicking motion. In this view the first side rail 56 is rotated in a clockwise direction, and the second side rail 58 is rotated in a counter-clockwise direction. According to various embodiments, the first hinge 60 may be generally elongate and extending along the first lateral side 26, and the second hinge 60 may be generally elongate and extending along the second lateral side 28. The first hinge 60 may have a cross-sectional area less than a cross-sectional area of the first side rail adjacent the first hinge, and the second hinge 62 may have a cross-sectional area less than a cross-sectional area of the second side rail 58 adjacent the second hinge 62. It is contemplated that the first and second side rails 56, 58 may be formed of an inner structural material, such as a plastic, that is stiffer than a surrounding outer material, such as a softer silicon rubber.

The first hinge 60 may be integrally formed with the first side rail 56, and the second hinge 62 may be integrally formed with the second side rail 58. Further the first hinge 60 may be integrally formed with a portion of the first lateral side 26 and the sole 24, and the second hinge may be integrally formed with a portion of the second lateral side 28 and the sole 24. In this regard, the foot pocket 14 may be manufactured though an overmolding process that foul's the upper portion 22, the sole 24 and the first and second hinges 60, 62, and portions of the first and second side rails 56, 58.

The fin blade 16 further may further include first and second fin body members 66, 68. The first and second fin body members 66, 68 may be generally planar. The first fin body member 66 may be disposed between and attached to the first side rail 56 and the flex member 64, and the second fin body member 68 may be disposed between and attached to the second side rail 58 and the flex member 64. The flex member 64 may have a stiffness less than a stiffness of each of the first and second fin body members 66, 68. The flex member 64 may further each have a stiffness less than a stiffness of the first and second side rails 56, 58. As such, it is contemplated that in addition to the first and second hinges 60, 62 facilitating rotational movement of the first and second side rails 56, 58, the flex member 64 also facilitates such movement. In addition, the swim fin 10 may include blade gaps 74 that are disposed adjacent the first and second hinges 60, 62 respectively between the first and second side rails 56, 58 and the first and second lateral sides 26, 28 towards the front section 18. This lack of structural connective material further facilitates such rotational movement or flexing.

According to yet another embodiment, there is provided a swim fin 10 for wearing upon the foot 12 of a user. The swim fin 10 includes the foot pocket 14 and a fin blade 16. The foot pocket 14 has the front section 18, the rear section 20, the first lateral side 26 and the opposing second lateral side 28 with the lateral sides 26, 28 being disposed along the front and rear sections 18, 20, the upper portion 22 formed of an elastomeric material, the sole 24, and the foot pocket cavity 32 disposed between the upper portion 22 and the sole 24. The fin blade 16 extends from the front section 18 of the foot pocket 14. The fin blade 16 has the first and second side rails 56, 58. Each side rail 56, 58 has the foot pocket end 70 and the blade tip end 72. The first side rail 56 is attached to the first lateral side 26 adjacent the foot pocket end 70 of the first side rail 56. The second side rail 58 is attached to the second lateral side 28 adjacent the foot pocket end 70 of the second side rail 58. The fin blade 16 further has the elastomeric flex member 64 attached to the front section 18 of the foot pocket 14 and attached to and disposed between the first and second side rails 56, 58. The flex member 64 extends from the front section 18 of the foot pocket 14 to adjacent and between the blade tip ends 72 of the first and second side rails 56, 58. The flex member 64 has a stiffness less than a stiffness of each of the first and second side rails 56, 58. The flex member 64 has corrugations 76 extending generally parallel to the first and second side rails 56, 58 adjacent the foot pocket ends 70. The fin blade 16 further has first and second fin body members 66, 68. The first and second fin body members 66, 68 are generally planar. The first fin body member 66 is disposed between and attached to the first side rail 56 and the flex member 64, and the second fin body member 68 is disposed between and attached to the second side rail 58 and the flex member 64. Each of the first and second fin body members 56, 58 having a stiffness greater than a stiffness of flex member 64.

The flex member 64 may be attached to the upper portion 22 at the front section 18 and adjacent to the first and second lateral sides 26, 28. The flex member 64 may be sized and configured to flex upon opposing rotational movement of the first and second fin body members 66, 68 about axes of rotation generally parallel to the first and second side rails 56, 58. As discussed above, in the view of FIG. 11, the first side rail 56 is rotated in a counter-clockwise direction, and the second side rail 58 is rotated in a clockwise direction. As such the flex member 64 assumes a U or V shape. Such shape is contemplated to facilitate a channeling of water flow from along the upper portion 22 of the foot pocket 14 towards and along the end of the fin blade 16 for enhanced propulsion. In the view of FIG. 12 the first side rail 56 is rotated in a clockwise direction, and the second side rail 58 is rotated in a counter-clockwise direction. As such the flex member assumes an upside-down U or V shape. Such shape is contemplated to facilitate a channeling of water flow from along the sole 24 of the foot pocket 14 towards the end of the fin blade 16 for enhanced propulsion. The channeling is further enhanced by the corrugations 76.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A swim fin comprising:

a foot pocket having a front section, a rear section, opposing lateral sides disposed along the front and rear sections, an upper portion formed of an elastomeric material, a sole, a foot pocket cavity disposed between the upper portion and the sole, and an insert anchor portion;

a fin blade extending from the front section of the foot pocket; and an adjustable heel strap attached to the lateral sides at the rear section of the foot pocket, the heel strap having:

an elongate flexible strap member extending across the foot pocket cavity adjacent the rear section;

a quick release insert having an insert body, a release clip, and a strap retention bar, the release clip and the insert anchor portion being cooperatively sized and configured for the insert anchor portion to receive the release clip along an axis of insertion, the release clip having a locked position with the release clip resisting removal of the release clip from within the insert anchor portion, the insert being rotatably engaged with foot pocket with the release clip inserted in the insert anchor portion in the locked position, the release clip having an unlocked position with the release clip not resisting removal of the release clip from within the insert anchor portion along the axis of insertion; and a strap adjustment member attached to the insert, the strap adjustment member being sized and configured to engage the strap member, the strap adjustment member having an engaged position with the strap adjustment member engaged with the strap member to resist longitudinal movement of the strap member about the strap retention bar, the strap adjustment member having an unengaged position with the strap adjustment member not engaged with the strap member.

2. The swim fin of claim 1 wherein the release clip having a circular body concentrically received by the insert anchor portion upon insertion of the release clip into the insert anchor portion in the locked position.

3. The swim fin of claim 1 wherein the release clip is configured to flex between the locked and unlocked positions.

4. The swim fin of claim 1 wherein the insert anchor portion being overmolded with the upper portion.

5. The swim fin of claim 1 wherein the strap member includes a plurality of protrusions disposed along the strap member, the strap adjustment member is configured to engage a respective one of the plurality of the protrusions in the engaged position.

6. The swim fin of claim 1 wherein the strap adjustment member is configured to flex between the engaged and unengaged positions.

7. A swim fin for wearing upon a foot of a user, the swim fin comprising:

a foot pocket having:

a front section;

a rear section;

a first lateral side and an opposing second lateral side, the lateral sides being disposed along the front and rear sections;

an upper portion formed of an elastomeric material;

a sole; and a foot pocket cavity disposed between the upper portion and the sole; and a fin blade extending from the front section of the foot pocket, the fin blade having:

first and second side rails, each side rail having a foot pocket end and a blade tip end;

first and second hinges, the first hinge being attached to the first lateral side and the foot pocket end of the first side rail, the second hinge being attached to the second lateral side and the foot pocket end of the second side rail, the first hinge being sized and configured to flex to allow rotation of the first side rail about an axis generally parallel to the first lateral side, the second hinge being sized and configured to flex to allow rotation of the second side rail about an axis generally parallel to the second lateral side; and an elastomeric flex member attached to the front section of the foot pocket and attached to and disposed between the first and second side rails, the flex member extending from the front section of the foot pocket to adjacent and between the blade tip ends of the first and second side rails, the flex member having a stiffness less than a stiffness of each of the first and second side rails.

8. The swim fin of claim 7 wherein the first hinge is generally elongate and extending along the first lateral side, the second hinge is generally elongate and extending along the second lateral side.

9. The swim fin of claim 7 wherein the first hinge has a cross-sectional area less than a cross-sectional area of the first side rail adjacent the first hinge, the second hinge has a cross-sectional area less than a cross-sectional area of the second side rail adjacent the second hinge.

10. The swim fin of claim 7 wherein the first hinge is integrally formed with the first side rail, and the second hinge is integrally formed with the second side rail.

11. The swim fin of claim 7 wherein the fin blade further includes first and second fin body members, the first and second fin body members are generally planar, the first fin body member is disposed between and attached to the first side rail and the flex member, the second fin body member is disposed between and attached to the second side rail and the flex member, the flex member having a stiffness less than a stiffness of each of the first and second fin body members.

12. A swim fin for wearing upon a foot of a user, the swim fin comprising:

a foot pocket having a front section, a rear section, a first lateral side and an opposing second lateral side, the lateral sides being disposed along the front and rear sections, an upper portion formed of an elastomeric material, a sole, and a foot pocket cavity disposed between the upper portion and the sole; and a fin blade extending from the front section of the foot pocket, the fin blade having:

first and second side rails, each side rail having a foot pocket end and a blade tip end, the first side rail being attached to the first lateral side adjacent the foot pocket end of the first side rail, the second side rail being attached to the second lateral side adjacent the foot pocket end of the second side rail;

an elastomeric flex member attached to the front section of the foot pocket and attached to and disposed between the first and second side rails, the flex member extending from the front section of the foot pocket to adjacent and between the blade tip ends of the first and second side rails, the flex member having a stiffness less than a stiffness of each of the first and second side rails, the flex member having corrugations extending generally parallel to the first and second side rails adjacent the foot pocket ends; and first and second fin body members, the first and second fin body members being generally planar, the first fin body member being disposed between and attached to the first side rail and the flex member, the second fin body member being disposed between and attached to the second side rail and the flex member, each of the first and second fin body members having a stiffness greater than a stiffness of flex member.

13. The swim fin of claim 12 wherein the flex member is sized and configured to flex upon opposing rotational movement of the first and second fin body members about axes of rotation generally parallel to the first and second side rails.

14. The swim fin of claim 12 wherein the flex member is attached to the upper portion at the front section and adjacent to the first and second lateral sides.

* * * * *